US011717075B2

(12) United States Patent
Cohen

(10) Patent No.: US 11,717,075 B2
(45) Date of Patent: Aug. 8, 2023

(54) APPARATUS FOR SECURED GROUND ANCHORING

(71) Applicant: Noam Cohen, Kfar-Saba (IL)

(72) Inventor: Noam Cohen, Kfar-Saba (IL)

( * ) Notice: Subject to any disclaimer, the term of this patent is extended or adjusted under 35 U.S.C. 154(b) by 101 days.

(21) Appl. No.: 17/295,426

(22) PCT Filed: Dec. 25, 2019

(86) PCT No.: PCT/IL2019/051409
§ 371 (c)(1),
(2) Date: May 19, 2021

(87) PCT Pub. No.: WO2020/136649
PCT Pub. Date: Jul. 2, 2020

(65) Prior Publication Data

US 2022/0000249 A1 Jan. 6, 2022

Related U.S. Application Data

(60) Provisional application No. 62/784,845, filed on Dec. 26, 2018.

(51) Int. Cl.
*A45F 3/44* (2006.01)
*E02D 5/80* (2006.01)

(52) U.S. Cl.
CPC ..... *A45F 3/44* (2013.01); *E02D 5/801* (2013.01)

(58) Field of Classification Search
CPC ..... A45F 3/44; A01K 97/10; A01G 9/122; E04H 12/2215
USPC ... 248/156, 545, 530, 532, 533, 80, 87, 507, 248/508
See application file for complete search history.

(56) References Cited

U.S. PATENT DOCUMENTS 585,486 A * 6/1897 Snow ..... E04H 12/32 248/156
4,832,304 A * 5/1989 Morgulis ..... A01K 97/10 248/533
5,692,720 A * 12/1997 Griggs ..... A45B 23/00 248/512
6,318,018 B1 * 11/2001 Weaver ..... A01K 97/10 43/21.2
6,575,853 B1 6/2003 O'Neill et al.
7,409,915 B2 8/2008 Hagar
7,472,874 B2 * 1/2009 Gross ..... E04H 12/2215 248/156
7,520,485 B1 * 4/2009 Giannetto ..... A01K 97/10 248/156

(Continued)

FOREIGN PATENT DOCUMENTS

AU 4078878 A 4/1980
GB 2410037 A 2/2004
GB 2516952 A 2/2015

*Primary Examiner* — Terrell L McKinnon
*Assistant Examiner* — Michael McDuffie
(74) *Attorney, Agent, or Firm* — Kristin Grant; Grant Attorneys At Law

(57) ABSTRACT

An apparatus for secured ground anchoring, including a stake that has a locking section at one end of the stake, an intermediate elongated portion and an anchoring section, a locking mechanism attached to the locking section, and a handle insertable into avoid within the stake, the handle is topped by a locking head connectable on top of the locking mechanism when the handle is inserted into the void.

14 Claims, 13 Drawing Sheets

(56) References Cited

U.S. PATENT DOCUMENTS

| | | | | |
|---|---|---|---|---|
| 7,559,218 | B2 * | 7/2009 | Soudan, Jr. | E04H 12/2223 70/58 |
| 7,739,796 | B2 * | 6/2010 | Froese | E04H 12/2253 29/897 |
| 8,407,949 | B2 * | 4/2013 | Kellner | F24S 25/617 52/157 |
| 8,561,362 | B2 * | 10/2013 | Dempsey | E02D 5/80 52/157 |
| 8,627,774 | B2 * | 1/2014 | Pearce | E05B 67/383 52/165 |
| 9,554,630 | B1 * | 1/2017 | Patel | A45B 25/18 |
| 10,077,893 | B1 * | 9/2018 | Abraham | F16B 7/105 |
| 10,119,293 | B1 * | 11/2018 | McCugh | E04H 12/2215 |
| 10,687,628 | B1 * | 6/2020 | Kite | E04H 12/2223 |
| 10,729,226 | B1 * | 8/2020 | Zamora | A45F 3/44 |
| 2006/0108495 | A1 * | 5/2006 | Walker | E04H 12/2223 248/522 |
| 2007/0007425 | A1 * | 1/2007 | Perotti | A45F 3/44 248/530 |
| 2007/0089771 | A1 * | 4/2007 | Jerry | E04H 12/2215 135/114 |
| 2014/0007487 | A1 * | 1/2014 | Schwiebert | A45F 3/44 114/295 |
| 2014/0026497 | A1 | 1/2014 | Dempsey | |
| 2018/0283033 | A1 | 10/2018 | Geslin | |

* cited by examiner

APPARATUS FOR SECURED GROUND ANCHORING

TECHNICAL FIELD

The present invention pertains apparatuses with a securing and guarding locking mechanism which are designed to laterally and vertically support, hold or lock objects, accessories and items into a ground platform. Particularly, the present invention pertains to apparatuses having a screws/pegs which are monolithically integrated with mechanical locking mechanism.

BACKGROUND

There are some known apparatuses for anchoring items to the ground. Several prior arts such as U.S. Pat. Nos. 7,409,915, and 7,559,218 disclose securing apparatuses and methods for securing items to a ground platform. GB 2410037 discloses a security portable anchor for securing personal possessions comprising as a peg an attached locking mechanism, which is optionally attached to an alarm system.

Some of the known anchoring apparatuses require a key or some other device to be carried by the user, for example for locking/unlocking, removing the device from the ground and/or removing the anchored items from the device. This may make these apparatuses inconvenient for use, for example at the beach, because of the weight of the key/device and the need to carry it on the user's body, for example by a pocket or a bag.

Moreover, some of the known anchoring devices may have some deficiencies when using such devices in sand, for example because sand may penetrate between and/or into small parts such as springs and small screws and other elements, causing wearing and cracking of the small part after several uses, which can degrade the reliability of the apparatus.

SUMMARY OF INVENTION

An aspect of some embodiments of the present disclosure provides an apparatus for secured ground anchoring, comprising: a stake comprising a locking section at one end of the stake, an intermediate elongated portion and an anchoring section; a locking mechanism attached to the locking section; and a handle insertable into a void within the stake, the handle is topped by a locking head connectable on top of the locking mechanism when the handle is inserted into the void.

Optionally, the apparatus includes a ring structure to be installed from below the locking mechanism, the ring structure mechanically connects to the locking mechanism or to the locking head.

Optionally, the apparatus includes a spiral blade at the anchoring section.

Optionally, the spiral blade has an angle of between 81 to 99 degrees with respect to a longitudinal plane of the stake at the anchoring section.

Optionally, the apparatus includes a hollow tip at the edge of the anchoring section.

Optionally, the hollow tip has a diagonal cut.

Optionally, when the locking mechanism is in a locked state, the handle cannot be pulled out from the stake or be inserted into the stake.

Optionally, when the locking head is connected on top of the locking mechanism and the locking mechanism is in a locked state, the locking head is locked to the locking mechanism.

Optionally, applying of rotational force on the locking mechanism does not result with the rotation of stake.

Optionally, the locking mechanism comprises a plurality of dial rings rotatable by a user to a determined combination, to unlock the locking mechanism.

Optionally, the handle comprises a handle insert section, and wherein the apparatus comprises a tubular member that can be pulled out from and pushed into the void of the stake, the tubular member includes two opposite openings on its wall, and wherein when in its pulled-out position, the handle insert section is insertable through the two openings.

Optionally, the tubular member is mechanically connected to the stake and rotatable together with the stake, and wherein when the handle insert section is inserted through the two openings, and rotational force is applied by the handle, this causes rotation of the rest of the stake.

Optionally, as long as the locking mechanism is unlocked, the handle may be inserted into the void in the stake through the tubular member, which may be pushed back into the stake.

Optionally, wherein the tubular member comprises snap-fit elements that fit into corresponding grooves in internal walls of the stake, the snap-fit elements prevent separation of the tubular member from the stake, while enabling limited vertical movement of the member, including pulling out of the member so that the openings emerge out from stake.

Optionally, wherein the locking head comprises two teeth extending from the bottom of the locking head, and when the locking mechanism is in its unlocked position, the teeth are insertable into corresponding openings in the locking mechanism, and when the locking mechanism is locked the teeth cannot be pulled out from the openings and the locking head cannot be separated from the mechanism.

Optionally, wherein the horizontal center of one tooth is not positioned exactly opposite the horizontal center of the other tooth.

Optionally, wherein the locking head comprises a central hole and a ring around the hole, and wherein the apparatus comprises a connector having a hollowed cylindrical tube element, having top and bottom tube elements spaced apart from each other by some gap, and a faucet locking element, wherein the faucet elements moves at least one internal shaft located in the top and bottom tube elements, to tightly connect the connector to the locking head ring

BRIEF DESCRIPTION OF THE DRAWINGS

Some non-limiting exemplary embodiments or features of the disclosed subject matter are illustrated in the following drawings.

In the drawings.

Figure 1A:
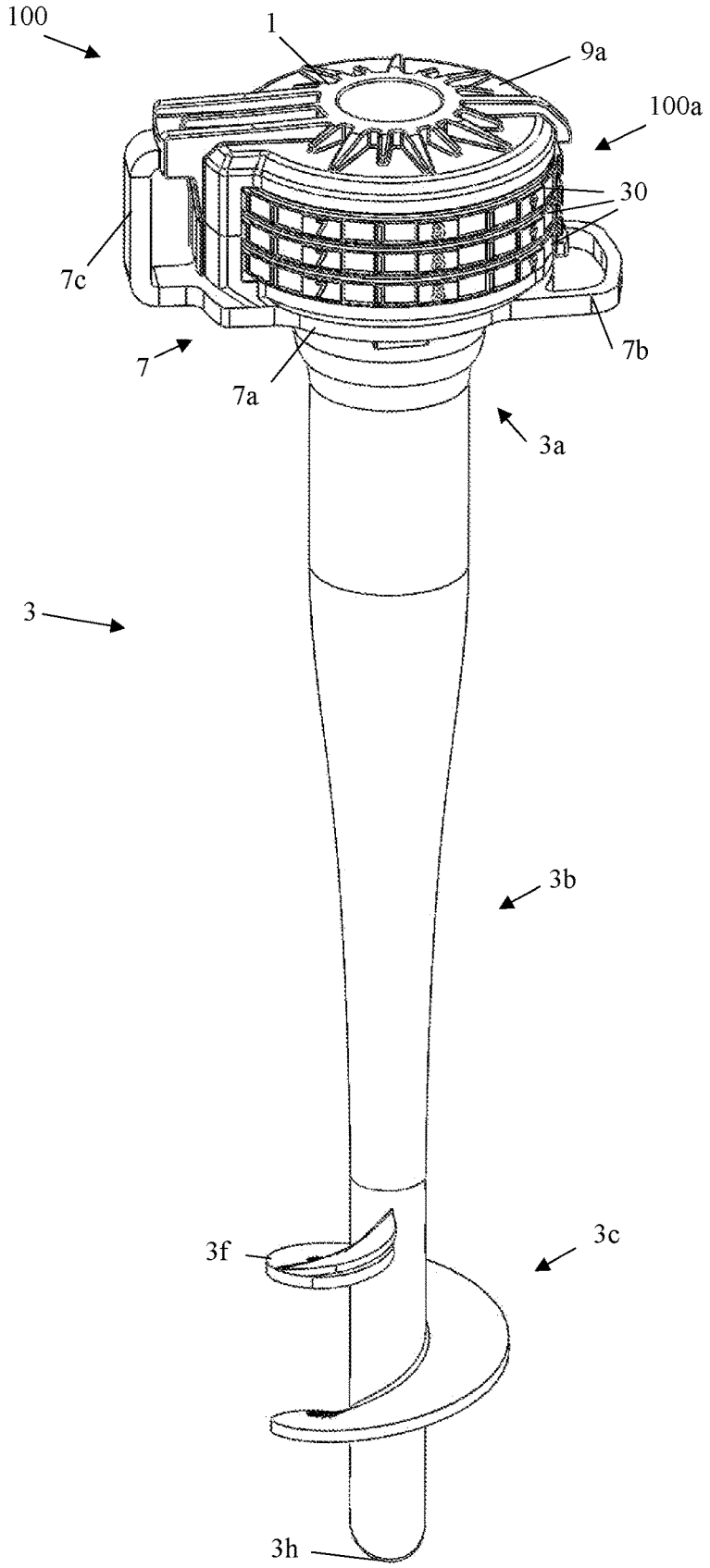
FIGS. 1A-E are schematic illustrations of an apparatus for secured ground anchoring, according to some embodiments of the present disclosure.

With specific reference now to the drawings in detail, it is stressed that the particulars shown are by way of example and for purposes of illustrative discussion of embodiments of the disclosure. In this regard, the description taken with the drawings makes apparent to those skilled in the art how embodiments of the disclosure may be practiced.

Identical or duplicate or equivalent or similar structures, elements, or parts that appear in one or more drawings are generally labeled with the same reference numeral, optionally with an additional letter or letters to distinguish between similar entities or variants of entities, and may not be repeatedly labeled and/or described. References to previously presented elements are implied without necessarily further citing the drawing or description in which they appear.

Dimensions of components and features shown in the figures are chosen for convenience or clarity of presentation and are not necessarily shown to scale or true perspective. For convenience or clarity, some elements or structures are not shown or shown only partially and/or with different perspective or from different point of views.

DETAILED DESCRIPTION OF THE DRAWINGS

The present invention discloses a modular stake/peg apparatus with an attached locking and encryption mechanisms. A stake/peg body part of the apparatus can be stuck in and/or screwed to a ground platform at beaches, parks or other locations with appropriate ground platforms, and then be locked by an encryption locking mechanism. The encryption mechanism is used to secure various objects and items with wires attached to pets, vehicles, accessories and other personal equipment.

screws/pegs or apparatuses with a securing and guarding locking mechanism which are designed to laterally and vertically support, hold or lock objects, accessories and items into a ground platform. Particularly, the present invention pertains to a screw/peg apparatus which are monolithically integrated with mechanical locking mechanism which is based on a special code-encryption mechanical mechanism.

Known devices are absent of the specific unique functionalities of encryption properties designed to lock the peg with a code, which comprises a plurality of digits. Furthermore, with respect to other encryption apparatuses, the present encryption apparatus is absent of springs and small screws and other elements, which can degrade the reliability of the encryption mechanism, thus ensuring a long time utility. Another issue is that the design of the apparatus of the present invention ensures securing the locking head to the stake/peg body part, disabling external forces and pressures from unlocking it, dismantling it or removing it out of the ground.

It is, therefore, an object of the present invention to provide a stake/peg apparatus with a locking and encryption mechanism, which is assembled at its top side, after its screwing into a ground platform, disabling its pull out without unlocking the attached locking and encryption mechanism.

It is yet another object of the present invention to provide a stake/peg apparatus, which is further integrated with an anchoring element, which is locked and opened by locking and unlocking a locking and encryption mechanism, enabling further to attach, secure and lock objects and items to the stake/peg apparatus.

It is yet another object of the present invention to provide a securing and locking module, which secures the locking and encryption mechanism to the stake/peg body part or body part to enable it to be rotated freely around the stake/peg apparatus.

In yet a further object of the present invention is provided a securing and locking mechanism that disables a direct applied force/pressure on the locking and encryption module by transferring said force/pressure to the stake/peg body part, thereby disabling a disassembly and dismantling of the locking and encryption module without a pull of the stake/peg apparatus.

In still another object of the present invention, the stake/peg apparatus and components thereof are designed to be adapted and modified according to the ground platform and environmental properties.

This and other objects and embodiments of the present invention shall become apparent as the description proceeds.

The present invention pertains to a stake or a peg, which are secured and guarded by a personalized code encryption locking mechanism which is used for locking objects, items and accessories to the peg or stake which is fixed to a platform in various outdoor locations.

Reference is now made to FIGS. 1A-E, which are schematic illustrations of an apparatus 100 for secured ground anchoring, for example anchoring to sand ground and/or soil, such as in the beach. FIG. 1A is a schematic perspective view illustration of apparatus 100 in its locked/closed state. Apparatus 100 includes a stake/peg 3. Stake 3 includes three main parts along its length: locking section 3*a* at one end of stake 3, intermediate elongated portion 3*b*, and anchoring section 3*c* towards the other end of stake 3. At section 3*a*, stake 3 is integrated with a locking and encryption mechanism 100*a*, topped with a locking head 9*a* of a handle 9, shown in FIG. 1B and described in more detail herein. For example, locking head 9*a* includes a circular shaped cylindrical top 1.

In some embodiments of the present invention, apparatus 100 also includes a ring structure 7, including a main ring 7*a* that can wrap/be inserted upon stake 3, for example upon the bottom of locking section 3*a*. Ring structure 7 may include at least one side ring 7*b*, to which items and/or belongings can be attached. Ring structure 7 may include at least one hook 7*c*. When locking head 9*a* is locked upon mechanism 100*a*, in some embodiments, locking head 9*a* is also locked to ring structure 7 and optionally to hook 7*c*. In some embodiments, head 9*a* connects with hook 7*c* to form additional ring, to which items and/or belongings can be attached. In some embodiments, ring structure 7 is rotatable about stake 3 together with mechanism 100*a*.

At section 3*c*, stake 3 is designed with a spiral blade structure 3*f* This design enables stake 3 to be screwed into a ground, for example by using screwing handle 9 as described in more detail below. At a distal end of section 3*c*, stake 3 may include a tip 3*h* that may enable fixing of stake/peg 3 in a certain location and then drilling it into the ground, in various types of soft and hard ground platforms. Such ground platform can be sand, hard soil, soil with implanted top grass layer and any other type of ground layer platform. In some embodiments, tip 3*h* may have a hollow cylindrical cross-section and/or a sharp edge, for example created by a diagonal cut.

In some embodiments, blade structure 3*f* has an angle θ as close as possible to a straight angle (90°) with respect to a longitudinal plane of stake 3 and/or with respect to the plane of the drilling direction A.

Handle 9 may be inserted into and/or be positioned in a void within stake 3, with its locking head 9*a* on top of mechanism 100*a*. When locking and encryption mechanism 100*a* is in a locked state, handle 9 cannot be pulled out from stake 3. Additionally, applying of rotational force on mechanism 100*a* may not be resulted with the rotation of stake 3. Applying of rotational force on mechanism 100*a* may be resulted with the rotation of mechanism 100*a* without stake 3. That is, stake 3 may not rotate together with mechanism 100*a*, for example when mechanism 100*a* is in its locked state and handle 9 cannot be pulled out from stake 3.

Locking mechanism 100*a* may include a locking and encryption module, for example including a plurality of dial rings 30. Dial rings 30 may be rotated by a user to a determined state such as, for example, a combination of numbers, to unlock locking mechanism 100*a*. Dial rings 30 may be rotated by a user to a another state such as, for example, another combination of numbers or any other state, to lock locking mechanism 100*a*. When locking head 100*a* is positioned on top of locking head 9*a* and when mechanism 100*a* is in its locked state, mechanism 100*a* and locking head 9*a* may be mechanically locked with each other.

Figure 1B:
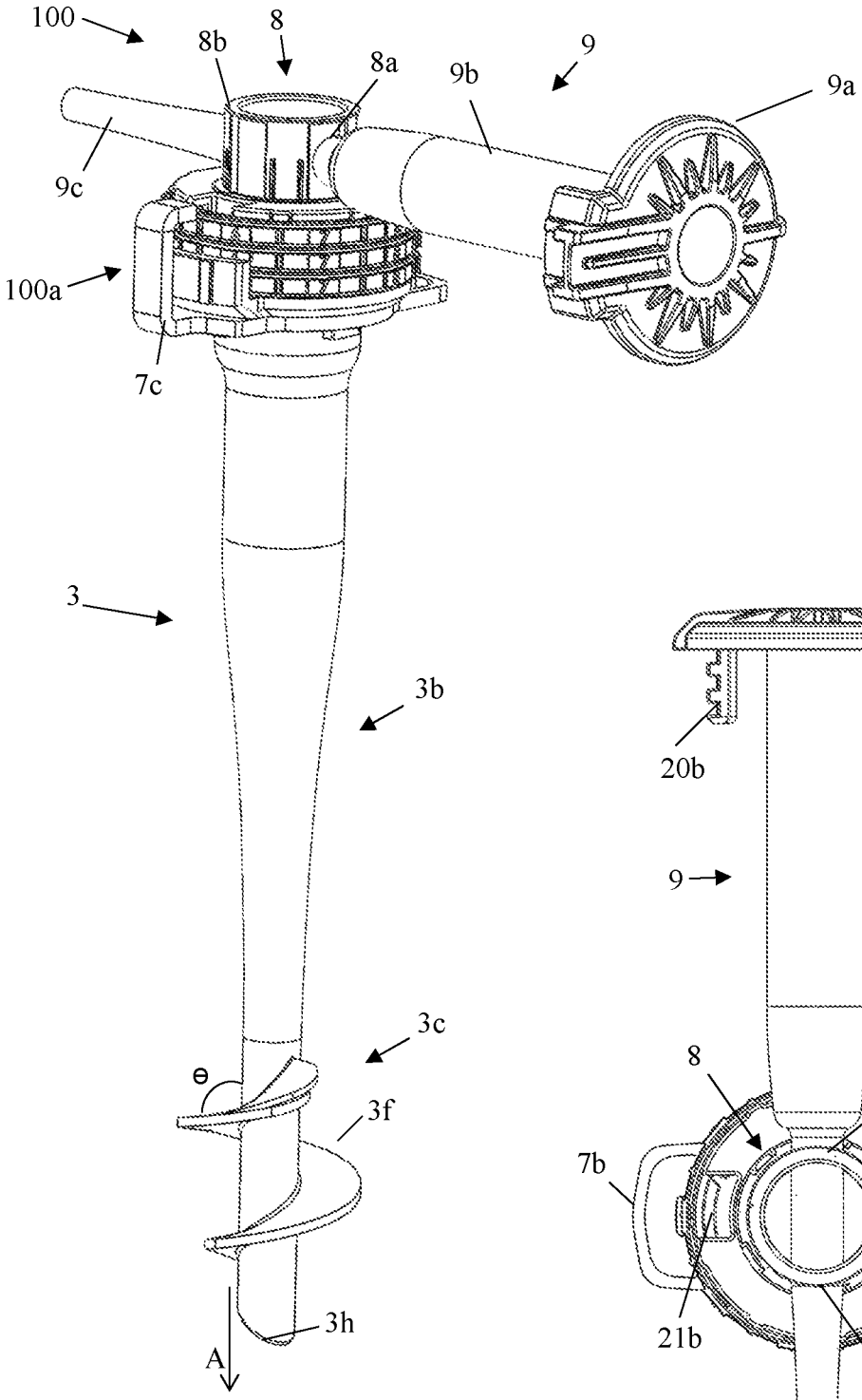
Figure 1C:
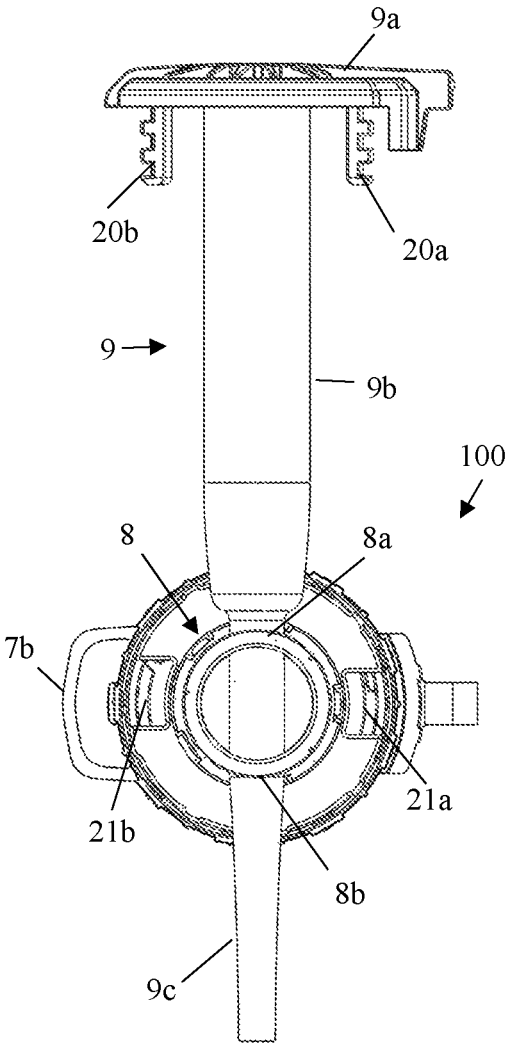

FIG. 1B is a schematic perspective view illustration of apparatus 100 in its unlocked/drilling state. FIG. 1C is a schematic top view illustration of apparatus 100 in its unlocked/drilling state. When locking and encryption mechanism 100*a* is in an unlocked state, handle 9 can be pulled out from stake 3. Handle 9 may include locking head 9*a*, handle grip section 9*b* and handle insert section 9*c*. In some embodiments, apparatus 100 includes a tubular member 8 that can be pulled out from/pushed into stake 3, for example when handle 9 is outside/removed from stake 3. Tubular member 8 may include two opposite openings 8*a* and 8*b* on its wall. When in its pulled-out position, handle insert section 9*c* may be inserted into and/or threaded through openings 8*a* and 8*b*.

Tubular member 8 may be mechanically connected to stake 3 and rotatable together with stake 3. For example, when handle insert section 9*c* is inserted through openings 8*a* and 8*b*, and rotational force is applied by handle 9, this causes rotation of the rest of stake 3, e.g. at least sections 3*b* and 3*c* rotate together with tubular member 8 and handle 9. Accordingly, when inserted into openings 8*a* and 8*b*, for example in the position shown, for example, in FIGS. 1B and 1C, handle 9 may be used to screw the stake/peg 3 into a ground platform, for example, be gripping handle 9 by locking head 9*a* and/or handle grip section 9*b* and applying a rotational force and/or drilling motion on stake 3, for example so that spiral blade structure 3*f* is screwed/threaded into the ground.

In some embodiments, when mechanism 100*a* is in its unlocked state, mechanism 100*a* is rotatable together with stake 3. when mechanism 100*a* is in its unlocked state, applying of rotational force on mechanism 100*a* and/or section 3*a* causes rotation of the rest of stake 3, e.g. sections 3*b* and 3*c* rotate together with mechanism 100*a* and/or section 3*a*, when mechanism 100*a* is in its unlocked state.

When handle 9 is not needed, for example after stake 3 is sufficiently threaded into the ground, for example in a sufficient depth, handle 9 may be removed from openings 8*a* and 8*b*, tubular member 8 may be pushed back into stake 3 to its inserted position, and/or handle 9 may be inserted into stake 3, for example through tubular member 8, so that locking head 9*a* is positioned on top of mechanism 100*a*.

Figure 1E:
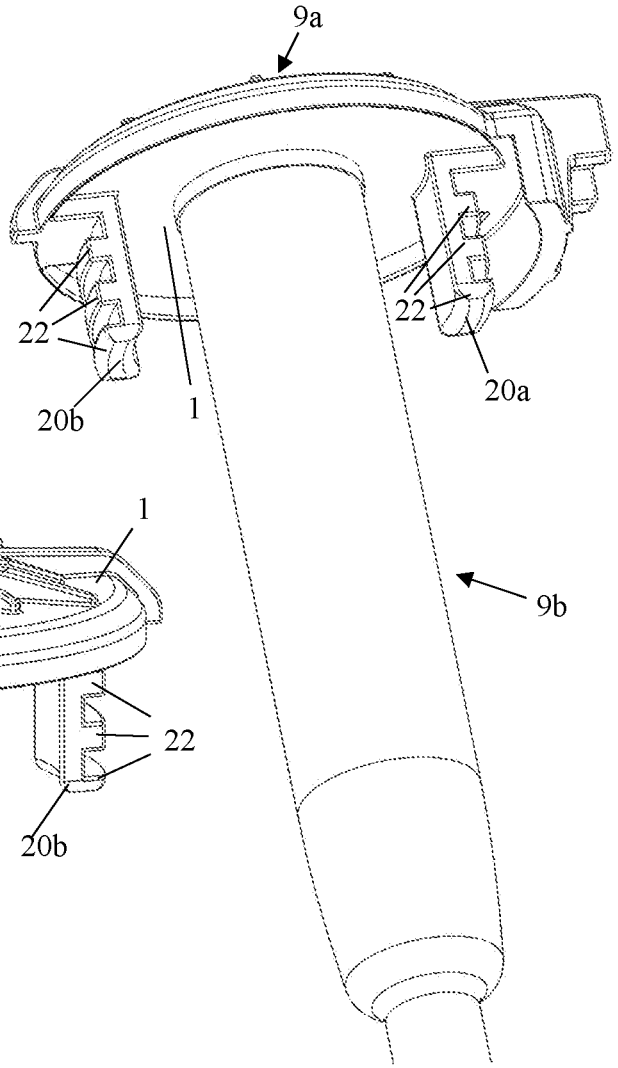
Figure 1D:
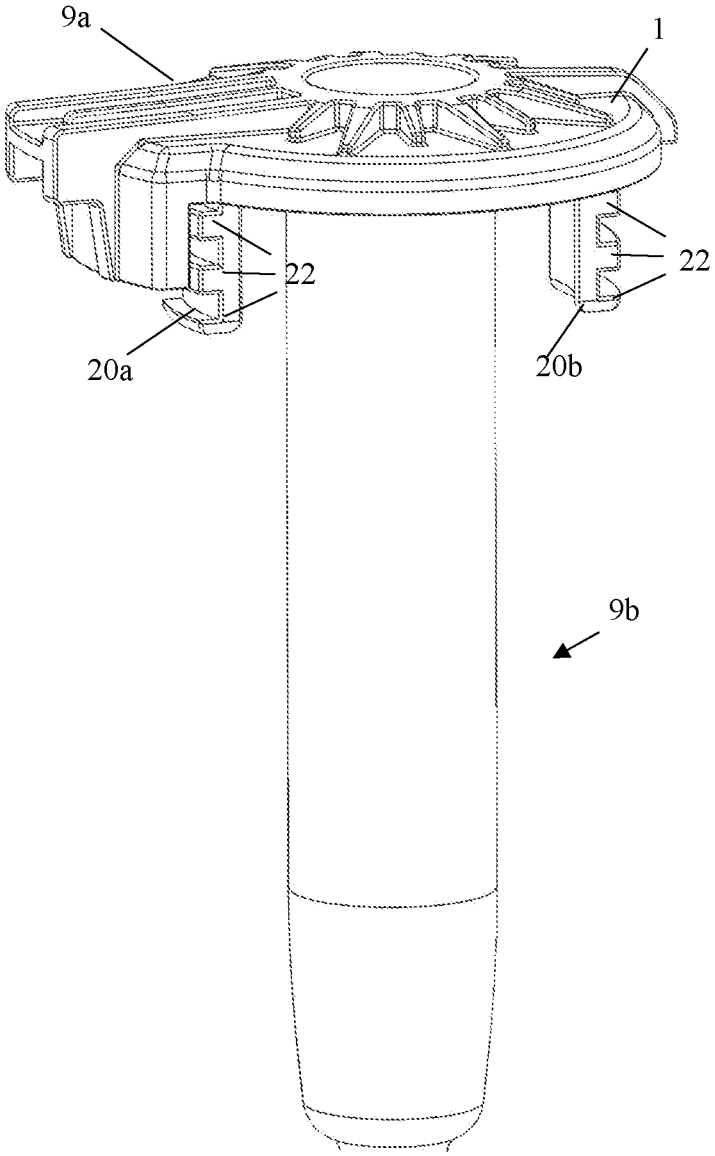

FIGS. 1D and 1E are larger schematic illustration of grip section 9*b* and locking head 9*a* of handle 9, from different angles. Locking head 9*a* includes teeth 20*a* and 20*b*, extending from the bottom of cylindrical top 1. In some embodiments of the present disclosure, the horizontal center of tooth 20*a* is not positioned exactly opposite the horizontal center of tooth 20*b*, but somewhat off the opposite direction from the horizontal center of tooth 20*b*. When locking mechanism 100*a* is in its unlocked position, teeth 20*a* and 20*b* may be inserted into corresponding openings 21*a* and 21*b* in locking mechanism 100*a*, positioned correspondingly to teeth 20*a* and 20*b*, respectively. Locking mechanism 100*a* may be locked, for example, by rotation of dial rings 30. Each tooth 20*a* and 20*b* may include a plurality of protrusions 22. When locking mechanism 100*a* is in its locked state, teeth 20*a* and 20*b* cannot be pulled out from openings 21*a* and 21*b* in locking mechanism 100*a*, and thus locking head 9*a* cannot be separated from mechanism 100*a*. For example, when locking mechanism 100*a* is in its locked state, corresponding protrusions and/or channels in mechanism 100*a* may prevent and/or limit horizontal and/or vertical movement of protrusions 22 relative to mechanism 100*a*, thus, for example, prevent and/or limit horizontal and/or vertical movement of teeth 20*a* and 20*b* and of locking head 9*a* relative to mechanism 100*a*.

Figure 2A:
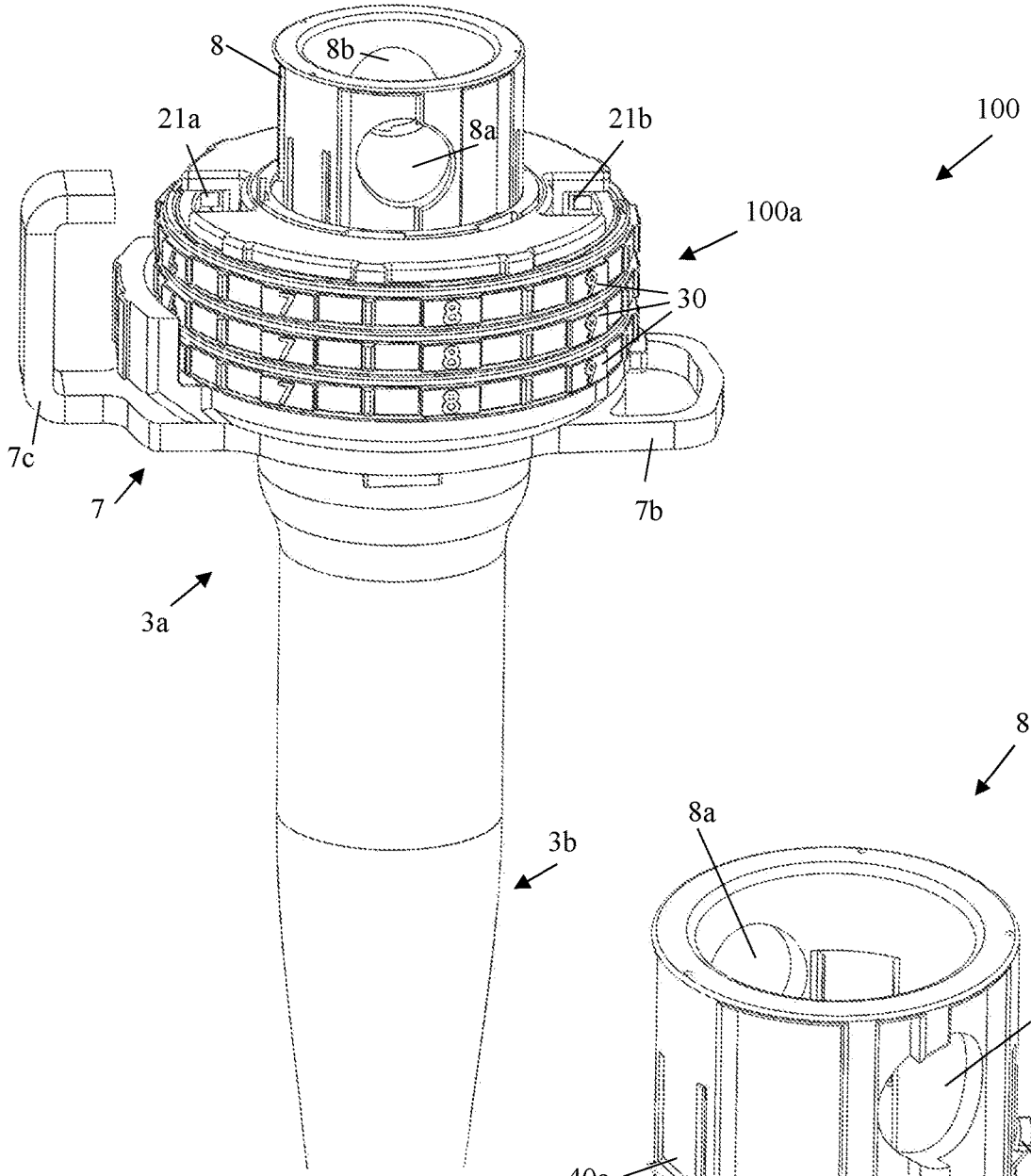
FIGS. 2A and 2B are schematic illustrations of a handle holder tubular member, according to some exemplary embodiments of the present disclosure.
Figure 2B:
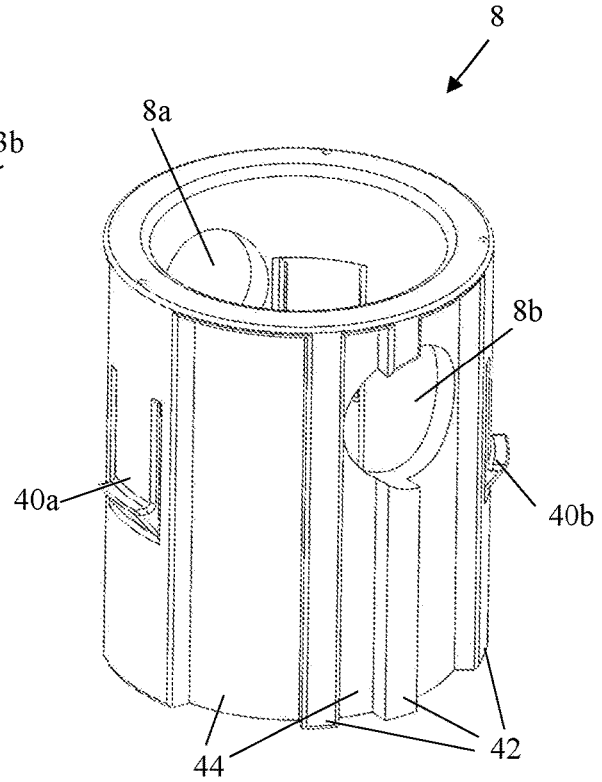

Reference is now made to FIGS. 2A and 2B, which are schematic illustrations of handle holder tubular member 8 that can be pulled out from/pushed into stake 3, for example when handle 9 is outside/removed from stake 3. Tubular member 8 may include two opposite openings 8*a* and 8*b* on its wall. When in its pulled-out position, handle insert section 9*c* may be inserted into and/or threaded through openings 8*a* and 8*b*.

As shown in FIG. 2B, tubular member 8 may include snap-fit elements 40*a* and 40*b*, that may fit into corresponding grooves in internal walls of stake 3. Snap-fit elements 40*a* and 40*b* may prevent separation of tubular member 8 from stake 3, while enabling limited vertical movement of member 8, such as pulling out of member 8 so that openings 8*a* and 8*b* emerge out from stake 3. Tubular member 8 may include a plurality of elongated vertical protrusions 42 and/or a plurality of elongated vertical grooves 44, that may match corresponding grooves and/or protrusions in internal walls of stake 3, which may act as tracks on which tubular member 8 may slide in an out stake 3. Tubular member 8 may be mechanically connected to stake 3 and rotatable together with stake 3. For example, when handle insert section 9*c* is inserted through openings 8*a* and 8*b*, and rotational force is applied by handle 9, this causes rotation of the rest of stake 3, e.g. at least sections 3*b* and 3*c* rotate together with tubular member 8 and handle 9.

Figure 3A:
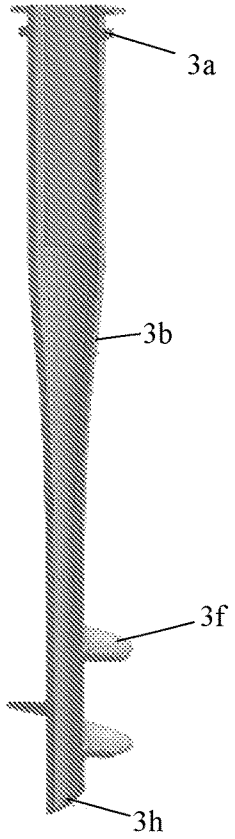
FIGS. 3A and 3B shows two plane-views of two correctional cuts of a peg/stake, according to some embodiments of the present disclosure.
Figure 3B:
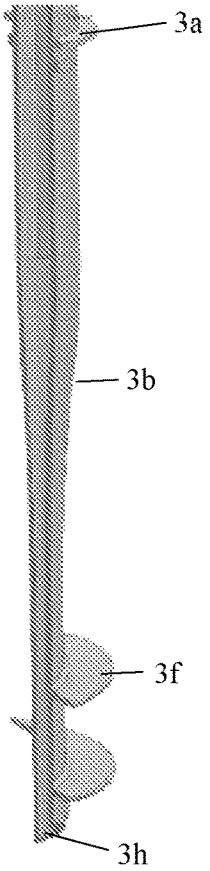

FIGS. 3A and 3B shows two plane-views of two correctional cuts of the peg/stake 3 along its central axis. In one preferred embodiment, the peg/stake 3 is designed as a hollow cylindrical shape ending in a sharp edge and a related hole 3*h*, created by diagonal cut along its bottom side.

Figure 4A:
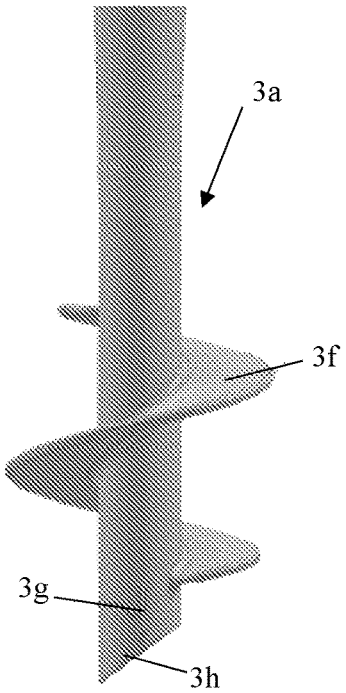
FIGS. 4A and 4B illustrate a perspective zoom-in view of the edge of a bottom side of a stake, according to some embodiments of the present disclosure.
Figure 4B:
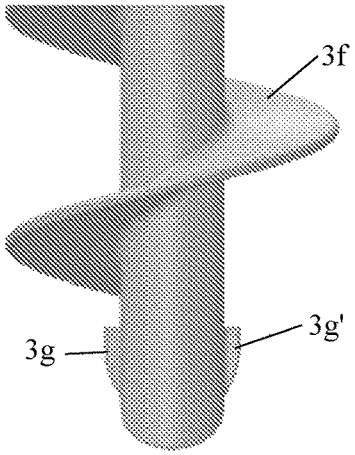

FIGS. 4A and 4B illustrate a perspective zoom-in view of the edge of stake/peg 3 bottom side. In some embodiments, section 3*c* includes two projections wing-shape elements with a bottom curved shape ended in a sharp angle and a flat top shape 3*g*, 3*g*'. This design enables the peg/stake 3 to be easily drilled or dug down, or alternatively screwed with the screwing handle 9 into a hard or soft ground platform. This design enables to fix the stake/peg 3 in a certain position and then stick it into the ground and enable a further digging of the peg/stake 3 in various types of soft and hard ground platforms. Such ground platform can be sand, hard soil, soil with implanted top grass layer and any other type of ground layer platform.

In yet another particular embodiment, the angle and size of wing shape elements 3*g*, 3*g*' positioned at the peg/stake bottom side, vary to fit the ground platform. In this case, the variation and tuning of the shape of these wing shape elements can be done several times in order to achieve a certain state in which it is impossible to pull out the Peg/Stake out of the ground.

Figure 5A:
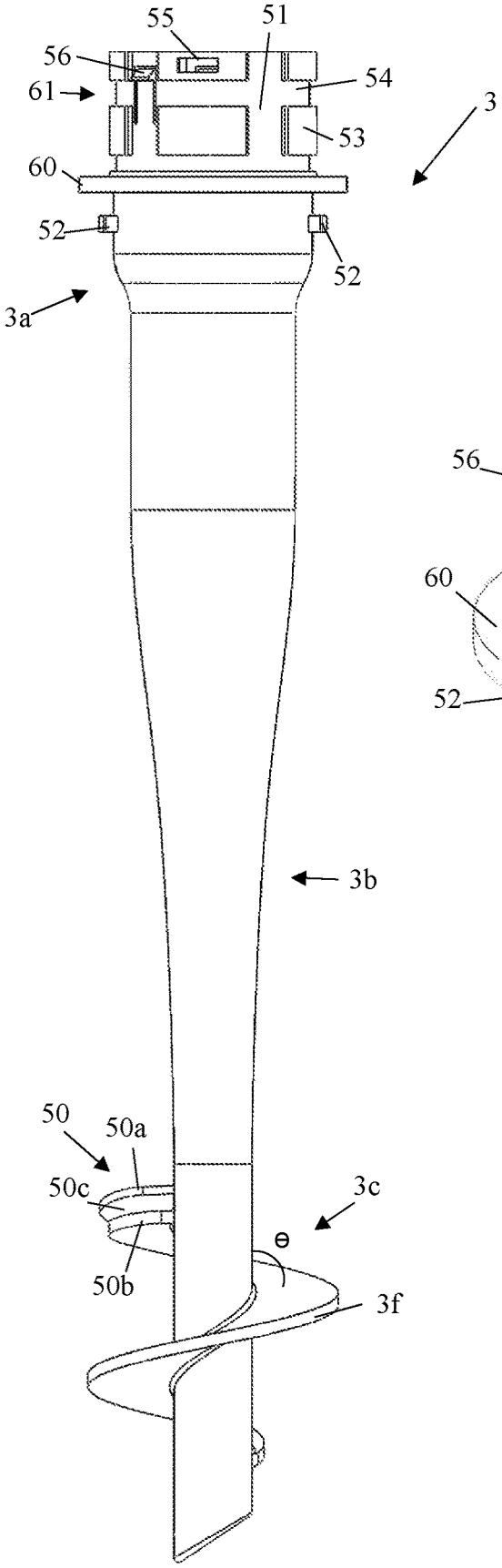
FIGS. 5A and 5B are schematic illustrations of a stake, according to some embodiments of the present disclosure.
Figure 5B:
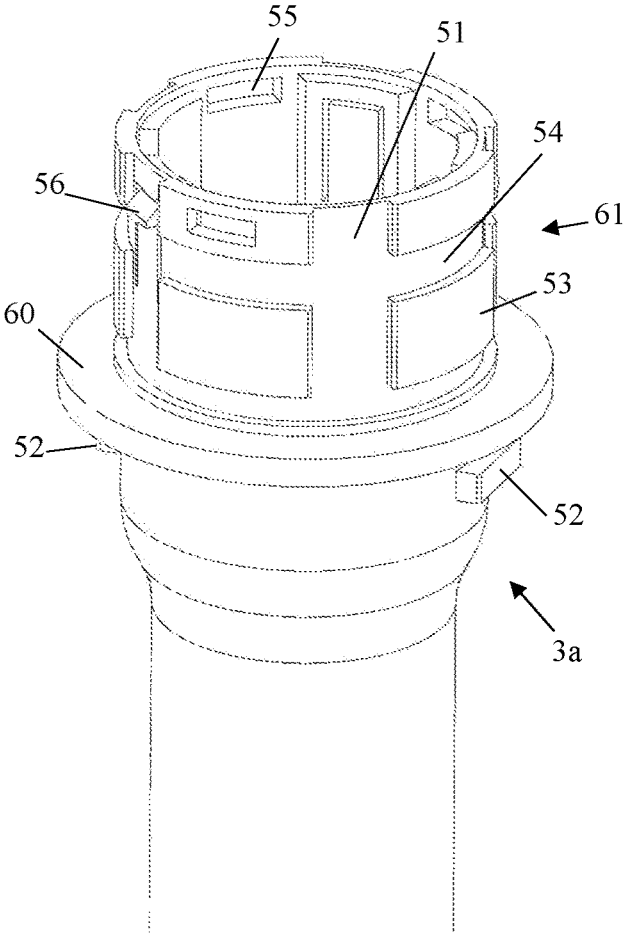

Reference is now made to FIGS. 5A and 5B, which are schematic illustrations of stake 3, according to some embodiments of the present disclosure. According to some embodiments, spiral blade structure 3*f* includes in its portion, for example in its upper portion, a double layered blade portion 50. For example, blade structure 3*f* may split, for example at its upper portion, to two blade layers 50*a* and 50*b*, with a gap 50*c* between them. When threading stake 3 into the ground, ground particles may enter to gap 50*c* between layers 50*a* and 50*b*. In some embodiments, blade structure 3*f* has an angle θ as close as possible to or about a straight angle (90 degrees), for example between 81 to 99 degrees, with respect to a longitudinal plane of stake 3 and/or with respect to the plane of the drilling direction A, creating a horizontal shoulder. In case someone tries to pull stake 3 out of the ground by force, the horizontal shoulder created by blade 3*f*, and/or the particles that penetrated gap 50*c*, may further make it difficult for them to pull stake 3 out from the ground.

At the top of section 3*a*, stake 3 may include a mechanism holder section 61, upon which mechanism 100*a* may be installed. Mechanism holder section 61 may be configured to hold mechanism 100*a* while enabling rotation of mechanism 100*a* about stake 3. Mechanism holder section 61 may include a plurality of protrusions 53, arranged so that horizontal tracks 54 and vertical indentations 51 are created between them. Additionally, section 3*a* includes snap-fit teeth 56 and slits 55. As discussed in more detail below, tracks 54 may allow mechanism 100*a* to rotate freely around stake 3. Below holder section 61, section 3*a* may include a ring shoulder 60 and/or protrusions 52. As described in more detail herein, for example, shoulder 60 may function to limit vertical movement of ring structure 7 from above, while protrusions 52 may function to limit vertical movement of ring structure 7 from below.

Figure 6A:
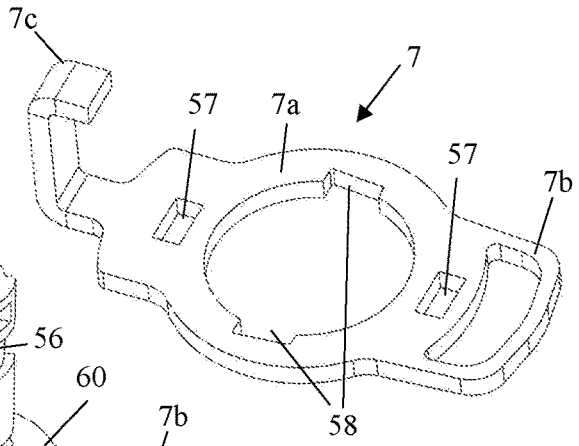
FIGS. 6A and 6B are schematic illustration of ring structure 7, according to some embodiments of the present disclosure.
Figure 6B:
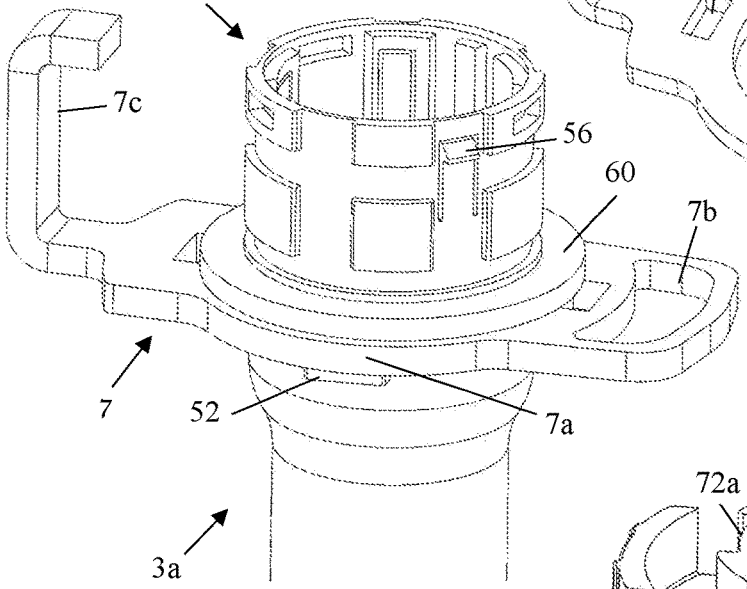

Reference is now made to FIGS. 6A and 6B, which are schematic illustration of ring structure 7, according to some embodiments of the present disclosure. As described herein, ring structure 7 may include a main ring 7*a*, a side ring 7*b* and/or a hook 7*c*. Ring structure 7 may include slits 57. As described in more detail herein, slits 57 may be used for mechanical connection with a segment of mechanism 100*a*, for example, by snap-fitting. Main ring 7*a* may include indentations 58, for example that extend out from its internal perimeter. The shape and relative location of indentations 58 may match the shape and relative location of protrusions 52. Ring structure 7 may be inserted onto section 3*a* by sliding structure 7 so that protrusions 52 are inserted through indentations 58. Then, once ring structure is rotated in any other direction, vertical movement of ring structure 7 is limited from below by protrusions 52 so that, for example, it cannot slide down on stake 3. The vertical movement of ring structure 7 is limited from above by shoulder 60. Moreover, in some embodiments, once mechanism 100*a* is installed, ring structure is held together with structure 100*a* by slits 57. In case someone tries to pull stake 3 out of the ground by pulling ring structure 7, the limitation by shoulder 60 and/or protrusions 52 cause dispersion of the force more evenly in all directions along shoulder 60, thus making the effective force to add up and/or be mainly in the vertical direction, where the movement of stake 3 is most limited by blade 3*f*.

Figure 7A:
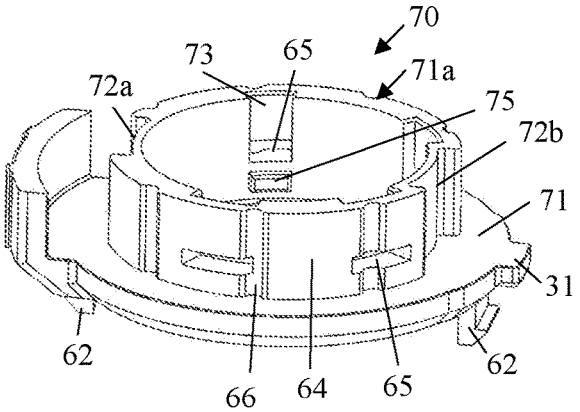
FIGS. 7A-7C are schematic illustration of a bottom segment of a locking mechanism, according to some embodiments of the present disclosure.
Figure 7B:
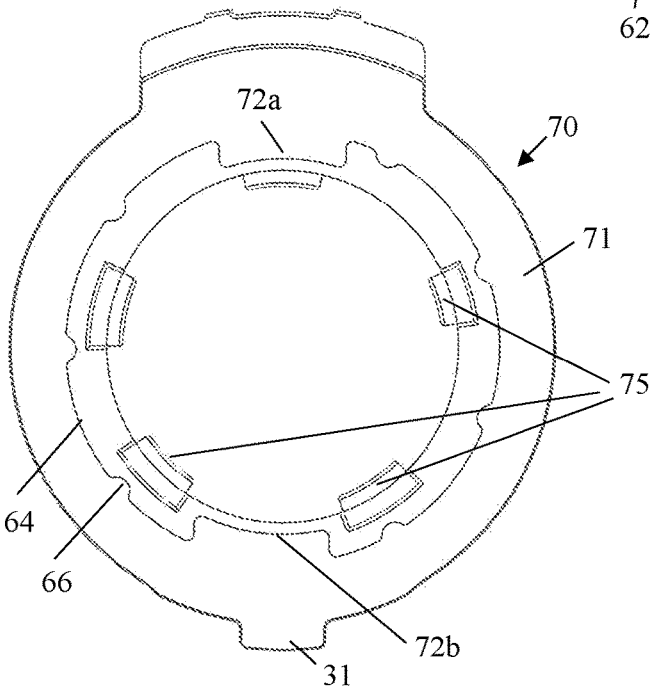
Figure 7C:
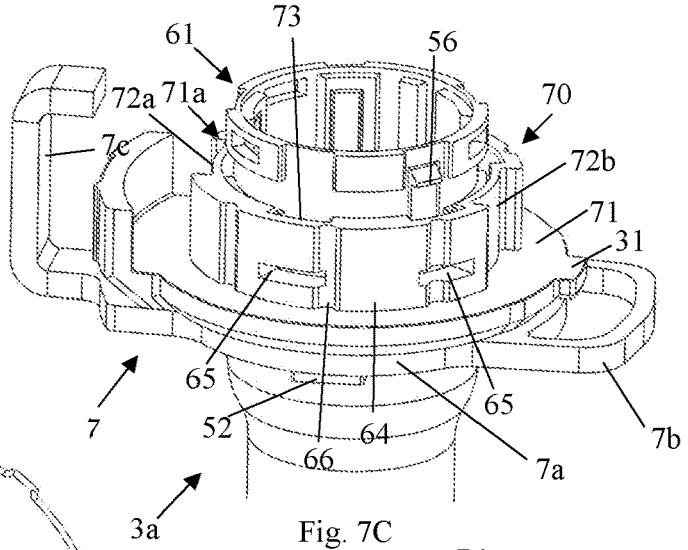

Reference is now made to FIGS. 7A-7C, which are schematic illustration of bottom segment 70 of locking mechanism 100*a*, according to some embodiments of the present disclosure. Bottom segment 70 may include a base 71 and a ring wall 71*a*. Ring wall 71*a* may include a plurality of slits 65 along its perimeter. On its external perimeter, bottom segment 70 may include indentations 72*a* and 72*b*, a plurality of bumps 64 and/or vertical grooves 66 in between bumps 64. On its internal perimeter, ring wall 71*a* may include internal protrusions 75 along the perimeter, and/or indentations 73, for example with each indentation 73 above a corresponding protrusion 75 and/or with a slit 65 at the bottom of indentation 73. When inserting segment 70 on mechanism holder section 61, protrusions 75 may slide, for example, on vertical indentations 51 of section 61. Once inserted, in case segment 70 is rotated about stake 3, protrusions 75 may slide in horizontal tracks 54 around section 61.

Moreover, bottom segment 70 includes snap-fit protrusions 62, extending down from the bottom of base 71. Protrusions 62 match in size and in relative locations to slits 57. When installed on holder section 61, protrusions 62 may snap-fit into slits 57 of ring structure 7, thus connecting bottom segment 70 to ring structure 7. Base 71 may include a tooth 31 extending outwards from base 71 at a certain location along the perimeter of base 71.

Figure 8B:
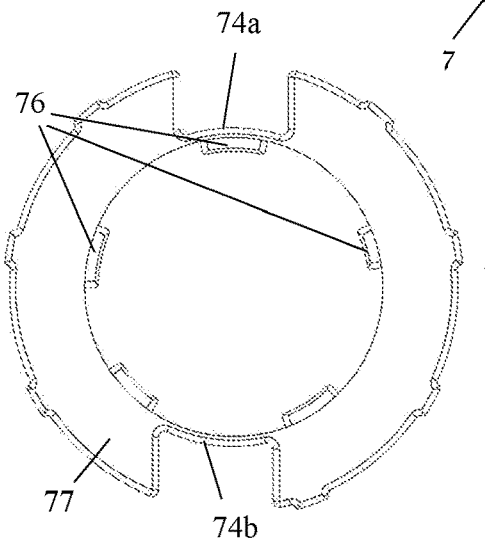
FIGS. 8A-8C are schematic illustration of a top segment of a locking mechanism, according to some embodiments of the present disclosure.
Figure 8A:
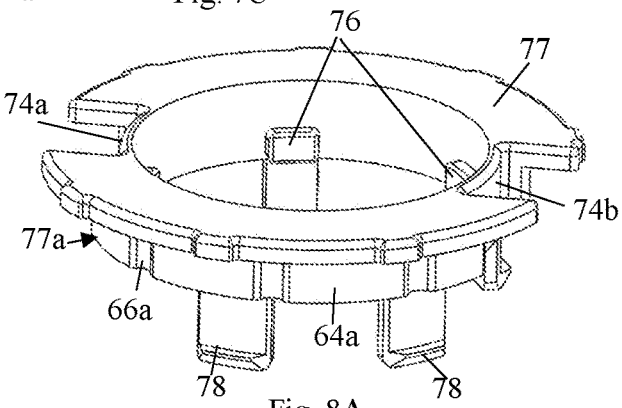
Figure 8C:
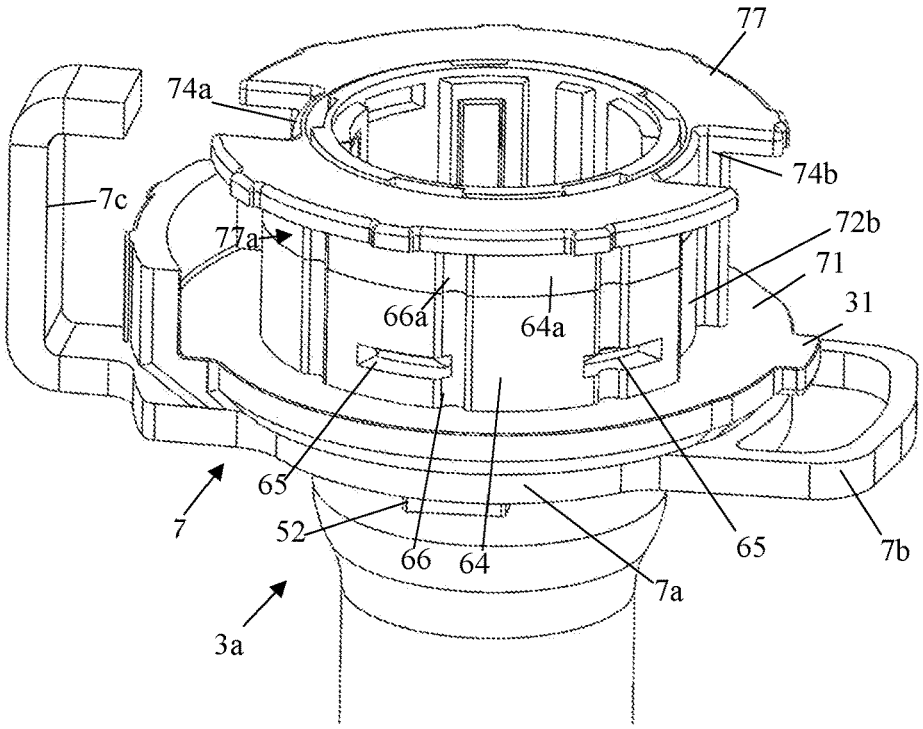

Reference is now made to FIGS. 8A-8C, which are schematic illustration of top segment 79 of locking mechanism 100*a*, according to some embodiments of the present disclosure. Top segment 79 may include a ring cover 77 and an under-ring 77*a*, having two indentations 74*a* and 74*b* that extend vertically along both cover 77 and under-ring 77*a*. On its external perimeter, below cover 77, segment 79 may include a plurality of bumps 64*a* and/or vertical grooves 66*a* in between bumps 64*a*, corresponding and/or matching in widths and/or relative locations to bumps 64 and/or vertical grooves 66 of segment 70. On its internal perimeter, top segment 79 may include internal protrusions 76 along the perimeter, for example matching in size and/or relative location along the perimeter to protrusions 75.

Indentations 74*a* and 74*b* may match in widths and/or relative locations to indentations 72*a* and 72*b*, respectively. In some embodiments of the present disclosure, the horizontal center of tooth indentations 72*a* and 74*a* are not positioned exactly opposite the horizontal center of indentations 72*b* and 74*b*, respectively, but somewhat off the opposite direction from the horizontal center of indentations 72*b* and 74*b*, respectively. Moreover, Top segment 79 may include a plurality of snap-fit extensions 78 that extend downwards below under-ring 77*a*. Snap-fit extensions 78 may match in sizes and/or in relative locations to slits 65 of bottom segment 70.

When inserting segment 79 on mechanism holder section 61 and on top of segment 70, protrusions 76 may slide, for example, on vertical indentations 51 of section 61. Once inserted, in case segment 79 is rotated about stake 3, protrusions 76 may slide in horizontal tracks 54 around section 61. Moreover, Snap-fit extensions 78 may be inserted into gaps created between holder section 61 and indentations 73 and fitted into slits 65. Thus, for example, top segment 79 is mechanically connected to bottom segment 70 and, for example, top segment 79 and bottom segment 70 may move together and/or be rotated together around stake 3 as one unit, both connected to ring structure 7. Moreover, once top segment 79 and bottom segment 70 are connected together, bumps 64*a* and/or vertical grooves 66*a* are aligned with bumps 64 and/or vertical grooves 66, respectively. When connected together, top segment 79 and bottom segment 70 form a locking mechanism skeleton 101.

Figure 9A:
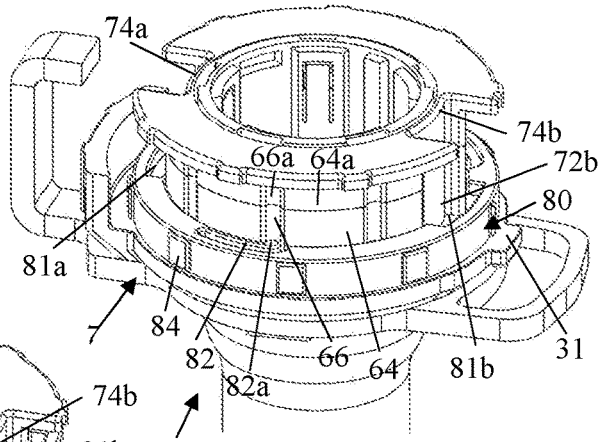
FIGS. 9A-9E are schematic illustrations of parts and a partially assembled top portion of the apparatus, according to some embodiments of the present disclosure.
Figure 9B:
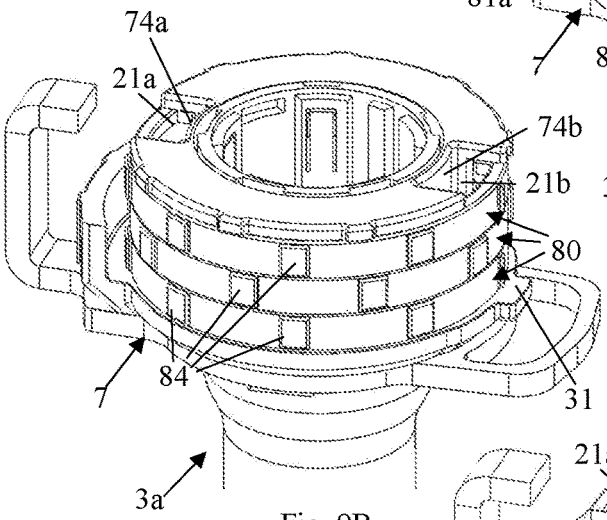
Figure 9C:
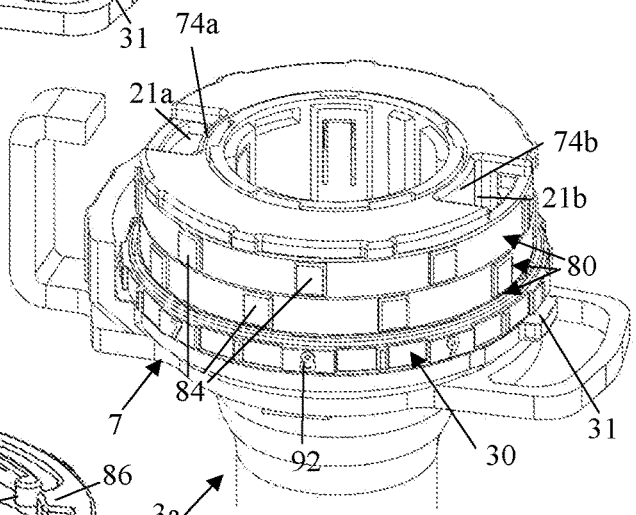
Figure 9D:
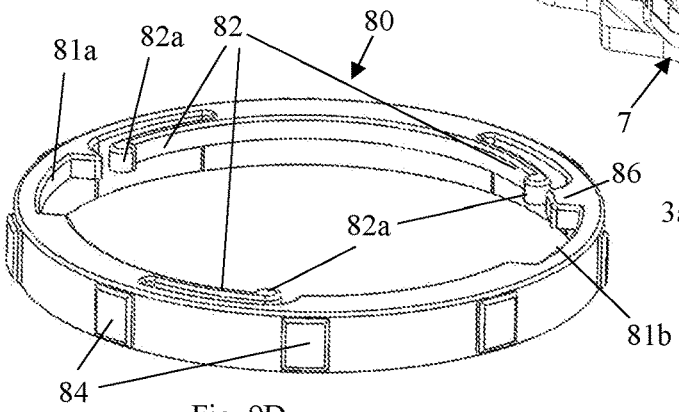
Figure 9E:
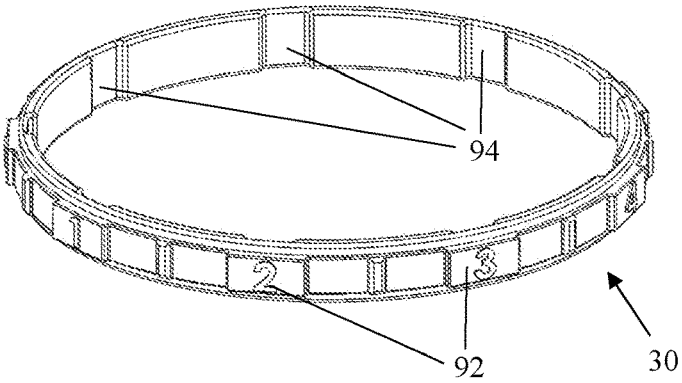

Reference is now made to FIGS. 9A-9E, which are schematic illustrations of a dial ring 30, a click ring 80, and a partially assembled top portion of apparatus 100, according to some embodiments of the present disclosure. As shown in FIGS. 9A-9C, click rings 80 are installed on skeleton 101. FIG. 9C also shows a dial ring 30 installed on a bottom click ring 80. In final installation, each click ring 80 may be covered by a dial ring 30 installed thereon, as shown in FIG. 1A. Click rings 80 and dial rings 30 may be installed on skeleton 101, e.g. on top segment 79 and bottom segment 70, for example before top segment 79 and bottom segment 70 are connected.

Click ring 80 includes on its internal perimeter a plurality of horizontally aligned pliant legs 82, indentations 81*a* and 81*b* and/or a tooth 86. On its external diameter, click ring 80 includes a plurality of bumps 84. Each pliant leg 82 may include a radially extending protrusion 82*a*. When installed on skeleton 101, click ring 80 may be rotated about skeleton 101. Whenever protrusion 82*a* becomes aligned with a groove 66 (or 66*a*), it may project into groove 66 (or 66*a*) and thus resist further movement of click ring 80 in the rotation direction and may produce a click sound when contacting groove 66 (or 66*a*). However, thanks to the flexibility of leg 82, continued and/or greater force may further move click ring 80 to rotate, for example while pushing protrusion 82*a* towards the internal perimeter of ring 80. Therefore, grooves 66 may provide segmentation to rotation of click ring 80 about skeleton 101.

Indentations 81*a* and 81*b* may match in size and/or relative location to indentations 72*a* and 72*b* and 74*a* and 74*b*, respectively. When ring 80 is aligned so that indentations 81*a* and 81*b* are positioned against indentations 72*a* and 72*b* and 74*a* and 74*b*, respectively, gaps are created between skeleton 101 and ring 80. Thus, for example, pits 21*b* and 21*a* are created between skeleton 101 and rings 80, when all rings 80 are aligned so that indentations 81*a* and 81*b* are positioned against indentations 72*a* and 72*b* and 74*a* and 74*b*, respectively. Pits 21*a* and 21*b* have openings at indentations 74*a* and 74*b*, respectively, and bottoms at base 71.

Ring 30 may be installed on click ring 80. Ring 30 may include marks on it, such as a series of characters, numbers, or letters. A user may choose a combination of characters, number of characters is the same as the number of click rings 80 installed on skeleton 101. Each ring 30 may be installed on a corresponding click ring 80 so that a selected character is positioned on a specific location along the perimeter of ring 80. The specific location may be marked upon ring 80 by a small tooth, a strip of colour, and/or by any other manner of marking. For example, the specific location may be marked by tooth 86.

Dial ring 30 may include a plurality of indentations 94 along the internal perimeter of ring 30. When installed on ring 80, indentations 94 fit tightly onto bumps 84. Thus, when installed together, ring 30 and ring 80 may be tightly connected and/or may move together as one unit.

When rings 80 with dial rings 30 are installed on skeleton 101, when click rings 80 are rotated to be aligned so that the selected characters in the selected order are aligned with a marking on skeleton 101, this is when all rings 80 are aligned so that indentations 81*a* and 81*b* are positioned against indentations 72*a* and 72*b*, and 74*a* and 74*b*, respectively, and/or pits 21*b* and 21*a* are created between skeleton 101 and rings 80. The marking on skeleton 101 may be a small tooth, a strip of colour, and/or by any other manner of marking. For example, the marking may be tooth 31. When pits 21*a* and 21*b* are created, mechanism 100*a* is unlocked.

As described herein, locking head 9*a* includes teeth 20*a* and 20*b*, extending from the bottom of cylindrical top 1. When locking mechanism 100*a* is in its unlocked position, teeth 20*a* and 20*b* may be inserted into and/or pulled out from openings 21*a* and 21*b* in locking mechanism 100*a*, respectively. Each tooth 20*a* and 20*b* may include a plurality of protrusions 22. When locking mechanism 100*a* is in its locked state, the shoulders of rings 80 are inserted between protrusions 22, and thus teeth 20*a* and 20*b* cannot be pulled out from openings 21*a* and 21*b* in locking mechanism 100*a*, and thus locking head 9*a* cannot be separated from mechanism 100*a*. the shoulders of rings 80 may prevent and/or limit vertical movement of protrusions 22 relative to mechanism 100*a*, thus, for example, prevent and/or limit vertical movement of teeth 20*a* and 20*b* and of locking head 9*a* relative to mechanism 100*a*.

FIGS. 10A-10H show an optional exemplary design for an assembly of various accessories for the stake/peg 3 assembled with locking and encryption mechanism 100*a*. In this case, this design utilizes a universal connector design 200, which is assembled on top of the related assembly.

Figure 10A:
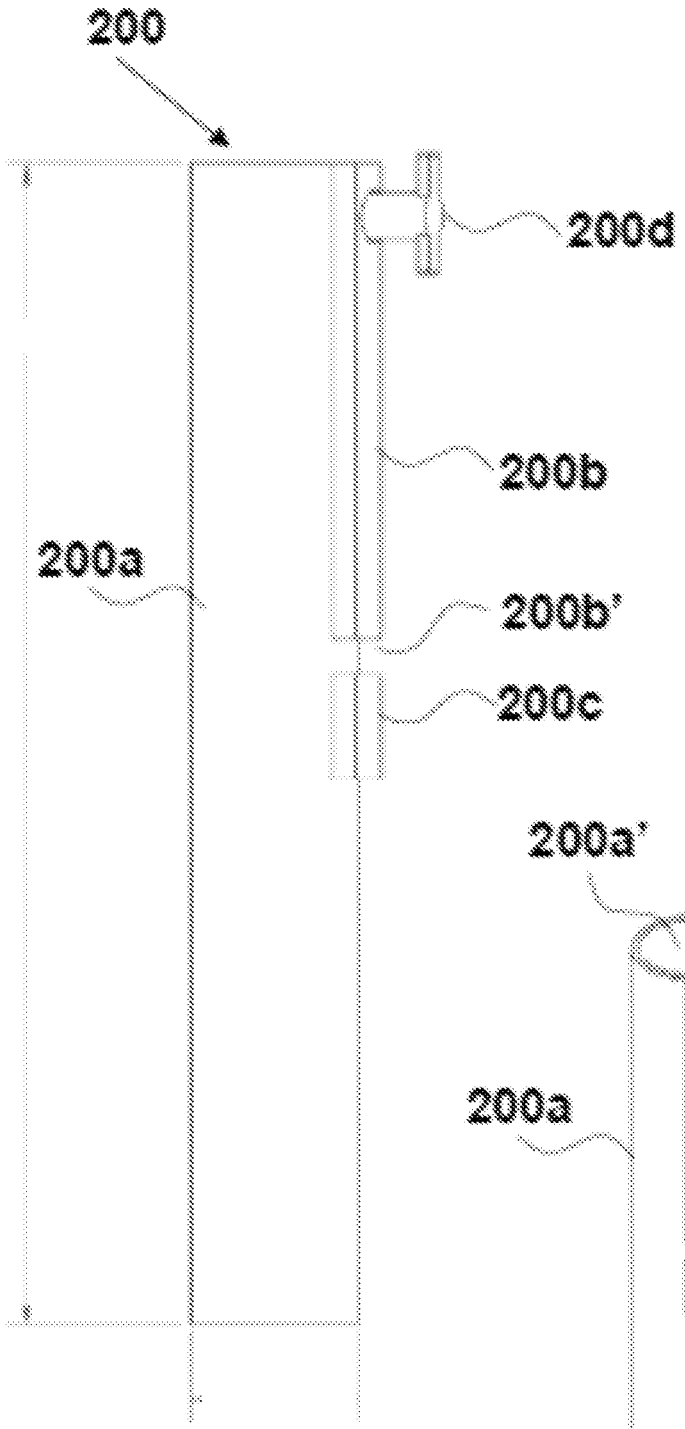
FIGS. 10A-10H show an optional exemplary design for an assembly of various accessories for the apparatus, according to some other embodiments of the present disclosure.
Figure 10B:
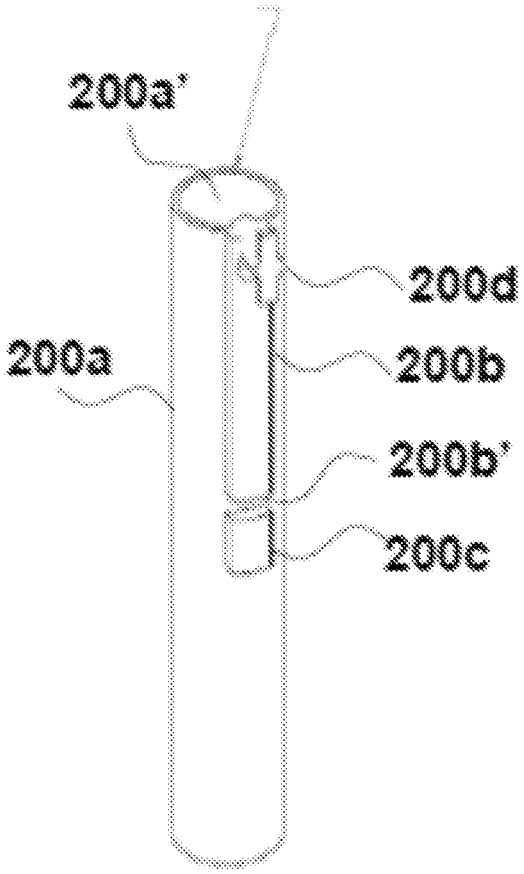

FIGS. 10A-10B illustrate a universal connector design 200, which enables a connection, attachment and support for a parasol 14 and various other accessories to apparatus 100 of the present disclosure. In this case, the universal connector element comprises of a hollowed cylindrical tube element 200*a*, which is designed with a mechanical lock along its top side. The mechanical lock comprises rectangular top and bottom tube elements 200*b*, 200*c* spaced apart from each other by some gap 200*b*' and a faucet locking element 200*d* comprising a T-shape screwing handle. The gap diameter along the rectangular tube main axis is a little bit larger than a vertical width of locking head to enable an insertion of circular shaped cylindrical top 1 of locking head 9*a* into gap 200*b*' and a further mechanical attachment of these two parts.

Figure 10C:
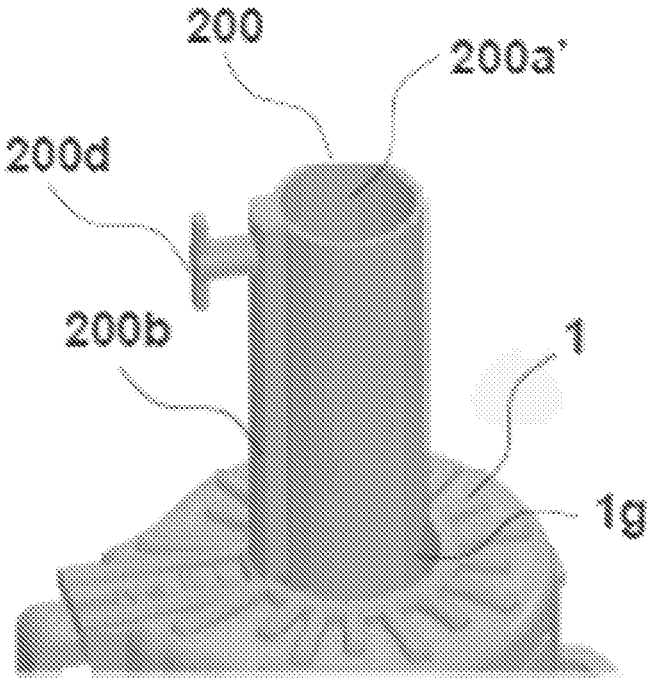
Figure 10D:
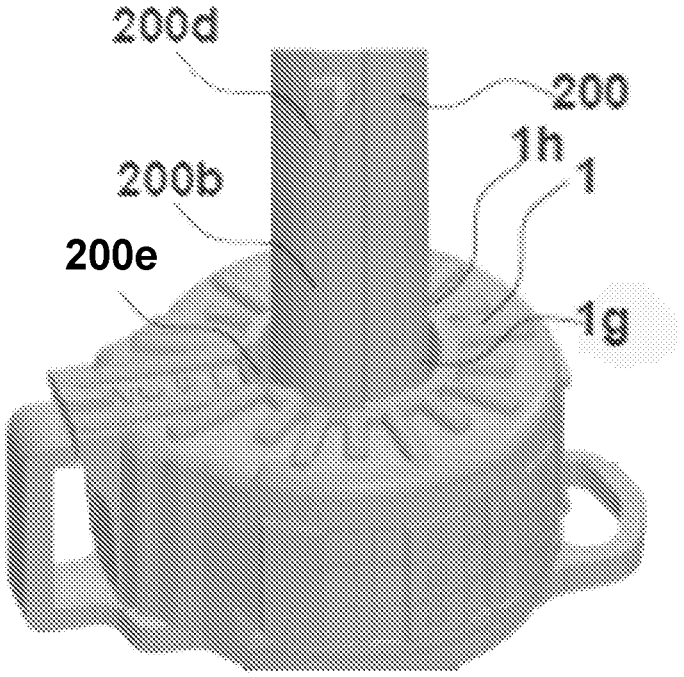

FIGS. 10C-10D illustrate the assembly of the universal connector design 200 with locking head 9*a*, which is assembled with the locking and encryption mechanism 100*a*. The connector is inserted through a circular hole 1*g* at cylindrical top 1 and through circular locking mechanism 100*a*. Rectangular tube elements 200*b*, 200*c*, are possibly inserted into a rectangular depression medium 200*e* made along the side of the locking head 1 and the locking mechanism 100*a*. After its insertion, the universal connector design 200 is rotated, fixed and attached to a locking head ring 1*h* designed around hole 1*g*. In the related configuration, the locking head ring part 1*h* is sandwiched between the rectangular tube elements 200*b*, 200*c* and located inside the space 200*b*', and is mechanically locked by an internal shaft (not shown) between the top and bottom parts 200*b*, 200*c*. When faucet locking element 200*d* is rotated, it may push and shift down vertically an internal shaft element (not shown) which presses and locks the universal connector rectangular parts 200*b*, 200*c* at the two sides of the locking head ring part 1*h*.

In one embodiment, the faucet's handle 200*d* is attached to an internal screw (not shown) which can lock several elements such as a parasol shaft 14*a* and other accessories. In this design, the faucet's handle 200*d* is rotated, screwing said screw through the top rectangular tube hollow element 200*b*, in vertical direction with respect to its main axis. The internal screw entered through a hole made at top side into the cylindrical tube hollow medium 200*a*'. This screw is used to lock elements which are inserted inside the medium of the cylindrical hollow medium 200*a*' by applying a pressure on these elements at a certain contact point. In a further embodiment, a shaft handle part not shown is embedded inside the rectangular hollow top part 200*b*. In this case, the faucet is additionally attached at its internal side to a vertical shaft element (not shown), which is shifted down, locking while it is rotated. This design utilizes a mechanical mediator part/mechanism which is connected between the internal screw and that shaft. This mediator element transforms the faucet's handle rotational part into a vertical linear translation part of the shaft inside the rectangular tube hollow element 200*b*. In this case, the shaft part is translated downward along the hollow tube element part 200*a*, entering gap 200*b*' between said top and bottom rectangular tube elements 200*b*, 200*c*. As a result, this locking mechanism is used for applying vertical pressure on the locking head cup 1 at a certain contact point, locking said universal connector 200 on top of apparatus 100.

Figure 10E:
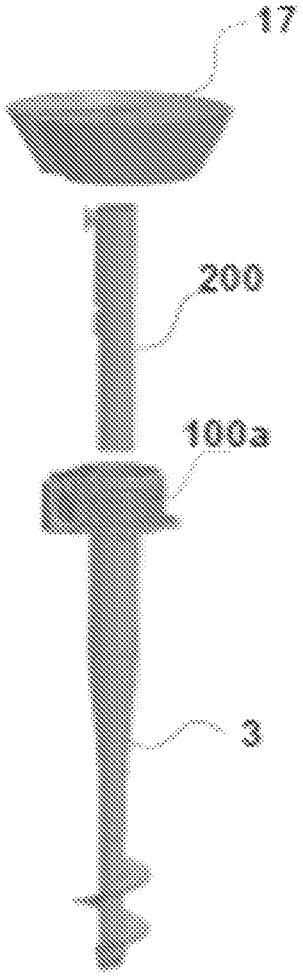
Figure 10F:
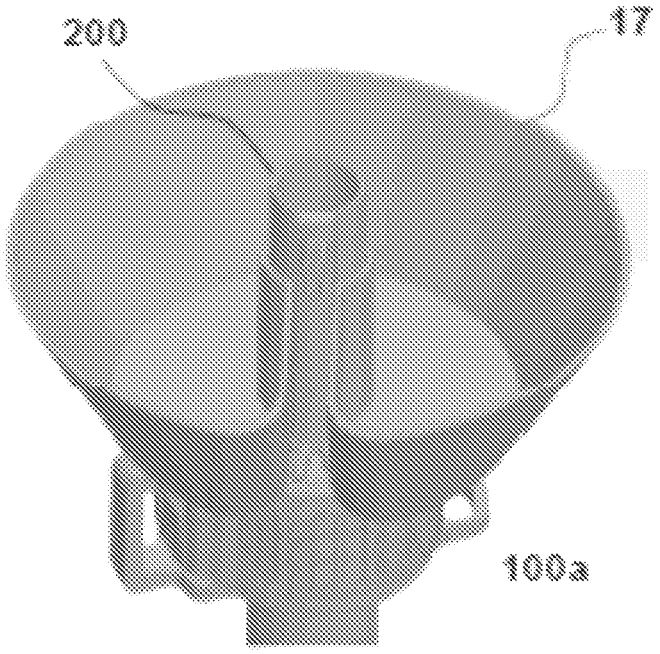

In general, the universal connector is designed to enable a connection of various accessories to apparatus 100. FIG. 10E illustrates an exploded view of the universal connector design 200 which is assembled on top of the stake/peg 3 with the locking and encryption element 100*a* with an additional container accessory 17. FIG. 10F illustrates a zoom-in view of the assembly of the container accessory 17 of the universal connector design 200 and the stake/peg 3. After the assembly of the container accessory 17 with the universal connector 200 and the stake/peg 3, it is locked via the faucet locking element 200*d* and attached to the locking head part 1, as explained above.

Figure 10G:
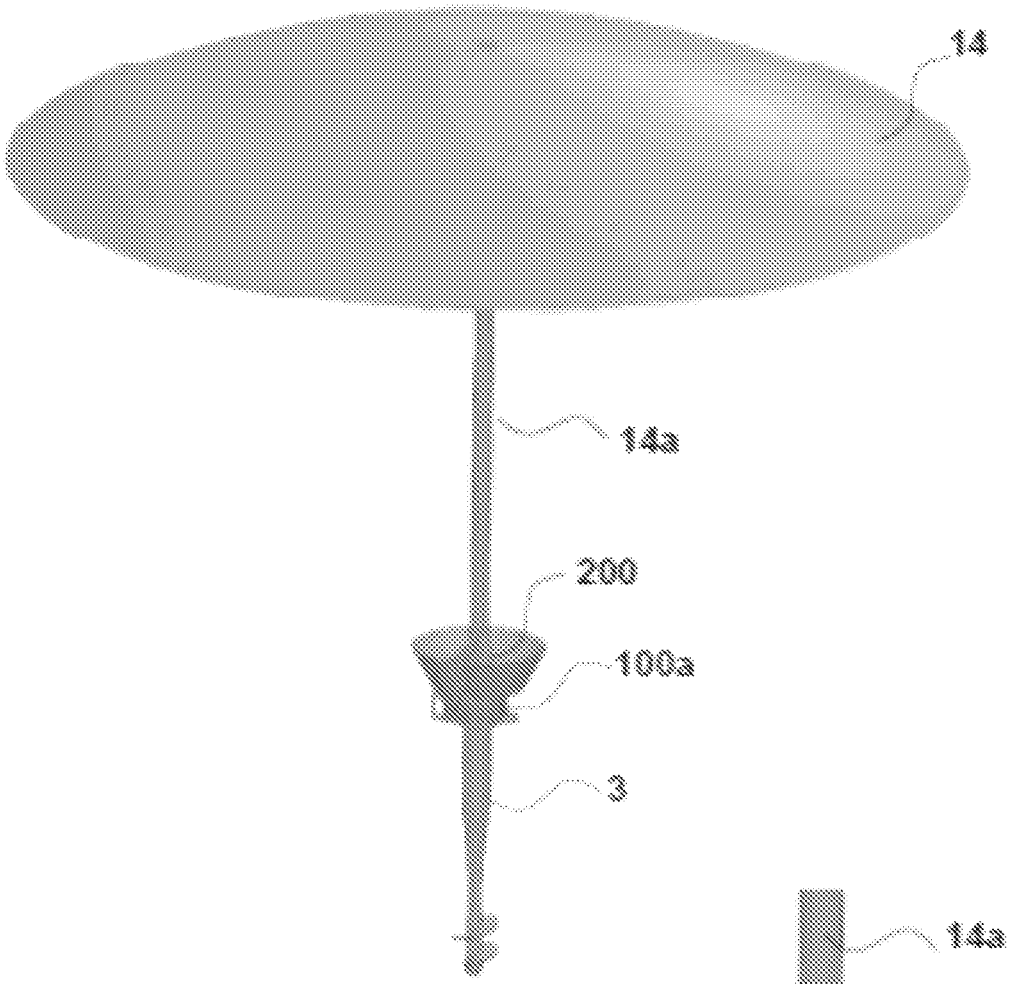
Figure 10H:
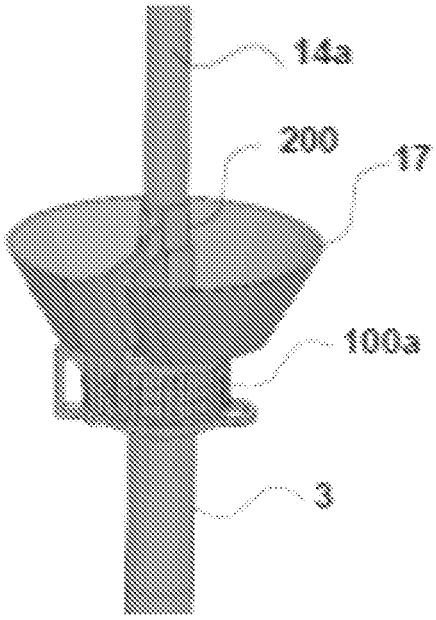

FIGS. 10G-10H illustrate the assembly of the universal connector design 200 assembled with container and parasol accessories 14, 17, respectively, on top of the locking and encryption mechanism 100*a*, which is assembled with apparatus 100. In this configuration, the parasol cylindrical shaft 14*a* is inserted into the universal connector 200. The faucet locking element 200*d* is rotated, locking the parasol 14*a* shaft to the universal connector 200 via an attached internal screw (not shown), as explained, also pushing down vertically, an internal shaft element (not shown) which presses and locks the universal connector rectangular parts 200*b*, 200*c* around the two sides of the locking head ring part 1*h*.

As demonstrated, the universal connector design 200 can attach a bowl of water, a solar panel for smartphone charge, or a standard parasol or any other item to apparatus 100 assembled with the locking and encryption module 100*a*. In a further embodiment, the universal connector has a threaded side along its one end which will enable to fix several types of accessories and gadgets and enable to lock them to the locking mechanism 100*a*.

The invention claimed is:

1. An apparatus for secured ground anchoring, comprising:

a stake comprising a locking section at one end of the stake, an intermediate elongated portion and an anchoring section;

a locking mechanism attached to the locking section; and a handle insertable into a void within the stake, the handle is topped by a locking head connectable on top of the locking mechanism when the handle is inserted into the void;

wherein the locking head comprises two teeth extending from the bottom of the locking head, and when the locking mechanism is in its unlocked position, the teeth are insertable into corresponding openings in the locking mechanism, and when the locking mechanism is locked the teeth cannot be pulled out from the openings and the locking head cannot be separated from the mechanism.

2. The apparatus of claim 1, comprising a ring structure to be installed from below the locking mechanism, the ring structure mechanically connects to the locking mechanism or to the locking head.

3. The apparatus of claim 1, comprising a spiral blade at the anchoring section.

4. The apparatus of claim 3, wherein the spiral blade has an angle of between 81 to 99 degrees with respect to a longitudinal plane of the stake at the anchoring section.

5. The apparatus of claim 1, comprising a hollow tip at the edge of the anchoring section.

6. The apparatus of claim 5, wherein the hollow tip has a diagonal cut.

7. The apparatus of claim 1, wherein when the locking mechanism is in a locked state, the handle cannot be pulled out from the stake or be inserted into the stake.

8. The apparatus of claim 1, wherein applying of rotational force on the locking mechanism does not result with the rotation of stake.

9. The apparatus of claim 1, wherein the locking mechanism comprises a plurality of dial rings rotatable by a user to a determined combination, to unlock the locking mechanism.

10. The apparatus of claim 1, wherein the handle comprises a handle insert section, and wherein the apparatus comprises a tubular member that can be pulled out from and pushed into the void of the stake, the tubular member includes two opposite openings on its wall, and wherein when in its pulled-out position, the handle insert section is insertable through the two openings.

11. The apparatus of claim 10, wherein the tubular member is mechanically connected to the stake and rotatable together with the stake, and wherein when the handle insert section is inserted through the two openings, and rotational force is applied by the handle, this causes rotation of the rest of the stake.

12. The apparatus of claim 10, wherein, as long as the locking mechanism is unlocked, the handle may be inserted into the void in the stake through the tubular member, which may be pushed back into the stake.

13. The apparatus of claim 10, wherein the tubular member comprises snap-fit elements that fit into corresponding grooves in internal walls of the stake, the snap-fit elements prevent separation of the tubular member from the stake, while enabling limited vertical movement of the member, including pulling out of the member so that the openings emerge out from stake.

14. The apparatus of claim 1, wherein the horizontal center of one tooth is not positioned exactly opposite the horizontal center of the other tooth.

* * * * *